US005364245A

United States Patent [19]

Kriehn et al.

[11] Patent Number: 5,364,245

[45] Date of Patent: Nov. 15, 1994

[54] DRY-RUNNING TWIN-SHAFT VACUUM PUMP

[75] Inventors: Hartmut Kriehn, Köln; Lothar Brenner, Bad-Münstereifel Eicherscheid, both of Germany

[73] Assignee: Leybold Aktiengesellschaft, Hanau, Germany

[21] Appl. No.: 74,858

[22] PCT Filed: Jan. 31, 1992

[86] PCT No.: PCT/EP92/00211

§ 371 Date: Jun. 8, 1993

§ 102(e) Date: Jun. 8, 1993

[87] PCT Pub. No.: WO92/14060

PCT Pub. Date: Aug. 20, 1992

[30] Foreign Application Priority Data

Feb. 1, 1991 [EP] European Pat. Off. ..... 91101331.6

[51] Int. Cl.[5] ..... F01C 1/30

[52] U.S. Cl. ..... 418/9; 418/200; 418/213; 277/13; 277/14 R; 277/55; 277/56; 277/72 R; 277/133

[58] Field of Search ..... 418/9, 200, 210, 212, 418/213, 215; 277/3, 55, 56, 58, 13, 14 R, 133, 72 R

[56] References Cited

U.S. PATENT DOCUMENTS

| | | | |
|---|---|---|---|
| 3,575,477 | 4/1971 | Newsome | 277/13 |
| 4,639,199 | 1/1987 | Frings et al. | 418/9 |
| 4,770,609 | 9/1988 | Uchida et al. | 418/9 |
| 4,940,398 | 7/1990 | Berges et al. | 417/410 |
| 4,983,107 | 1/1991 | Steffens et al. | 418/9 |
| 4,990,069 | 2/1991 | Guittet et al. | 277/55 |

FOREIGN PATENT DOCUMENTS

| | | | |
|---|---|---|---|
| 0290662 | 11/1988 | European Pat. Off. . | |
| 0368122 | 5/1990 | European Pat. Off. . | |
| 9215786 | 9/1992 | WIPO | 418/9 |

*Primary Examiner*—Richard E. Gluck
*Assistant Examiner*—Charles G. Freay
*Attorney, Agent, or Firm*—Felfe & Lynch

[57] ABSTRACT

Dry-running twin-shaft vacuum pump (1) with at least one pumping chamber (11, 12, 13), with a rotor pair (4-5, 6-7, 8-9) situated in the pumping chamber and borne by the shafts, and with a drive housing (21); in the pumping of toxic media, to limit the contaminated areas to components that are easy to assemble it is proposed that between the drive housing (21) and the adjoining pumping chamber (13) an intermediate plate be provided, which is traversed by the shafts (2, 3), contains the laterally exiting exhaust duct (52), and is releasable from the wall (17) of the drive housing (21).

8 Claims, 2 Drawing Sheets

DRY-RUNNING TWIN-SHAFT VACUUM PUMP

BACKGROUND OF THE INVENTION

The invention relates to a dry-running twin-shaft vacuum pump with at least one pumping chamber, with a pair of rotors situated in the pumping chamber and borne by the shafts, with a drive housing which is associated with one of the two ends of the pumping chamber, and with mountings which are situated in the section of wall of the drive housing facing the pump chamber and support the two shafts which pass through this wall section.

"Dry-running" vacuum pumps are pumps whose pump chambers contain no lubricant or sealants. Their advantage lies in the fact that they can produce vacuums completely free of hydrocarbons. However, it is impossible to dispense with the lubrication of the bearings of the shafts which bear the pistons rotating in the pump chambers. In dry-running pumps, therefore, it is necessary to assure an effective separation of the bearing chambers from the pump chambers. At the one end of the pump the shafts reach all the way into the drive housing in which a drive synchronizing the rotor motion is situated. Also, the sealing off of the oil containing drive chamber from the adjacent pump chamber must be assured.

On account of their particular property of being able to produce hydrocarbon-free vacuums, dry-running twin-shaft vacuum pumps are often used in the semiconductor industry, namely in apparatus in which etching or coating processes are performed under vacuum. The gases used or formed in these processes are often toxic. Maintenance or service operations are therefore decidedly complicated by decontamination or the contaminated parts of the pump.

EU-A-290,662 has disclosed a twin-shaft vacuum pump of the kind mentioned above. The drive housing adjoining the discharge-end pumping chamber functions simultaneously as a bearing plate. Consequently contamination of parts of the drive housing is unavoidable. Before performing installation work on the pump, therefore, these parts of the drive housing must also be contaminated, which additionally complicates maintenance.

The present invention is addressed to the problem of creating a twin-shaft vacuum pump of the kind described above, in which a safe separation between the drive chamber and the adjacent pumping chamber will be assured and in which maintenance and installation operations can be performed in a substantially simpler manner.

This problem is solved by the invention in that between the drive housing and the adjacent pumping chamber an intermediate plate is provided, through which the shafts pass, which contain a discharge line brought out laterally, and which is removable from the wall of the drive housing. In this system, additional means for separating the drive chamber from the adjacent pumping chamber can be provided between the shafts and the intermediate plate according to the invention. It is preferable for the shafts to be equipped in this area with bushings, preferably piston-ring bushings. Another important advantage has to do with the use of the pump according to the invention with toxic media. Due to the intermediate plate the contaminated part of the pump is clearly definable and separable from a non-contaminated area.

Pumps of the kind according to the invention, preferably with vertically disposed shafts, are usually built up sectionally. Assembly begins with the drive housing, the gears, shafts and drive bearings. This work calls for great care and therefore it is tedious. Then the components and rotors forming the pumping chambers are placed over the shafts successively and then only have to be tightened. Through the use of the intermediate plate according to the invention the assurance is provided that the complicated assembly part of the pump, namely the drive housing, is not part of the contaminated area. The contaminated area is limited to the parts that are easy to remove and install. After the removal of the contaminated parts the parts subject to wear (bearings, shaft sealing ring) are easy to reach. The drive housing, as the component difficult to assemble, is protected both against contaminants and against wear. Overall, a greater ease and simplicity of service procedures are achieved by the invention.

Additional advantages and details of the invention are to be explained with the aid of embodiments represented in FIGS. 1 and 2.

Figure 1:
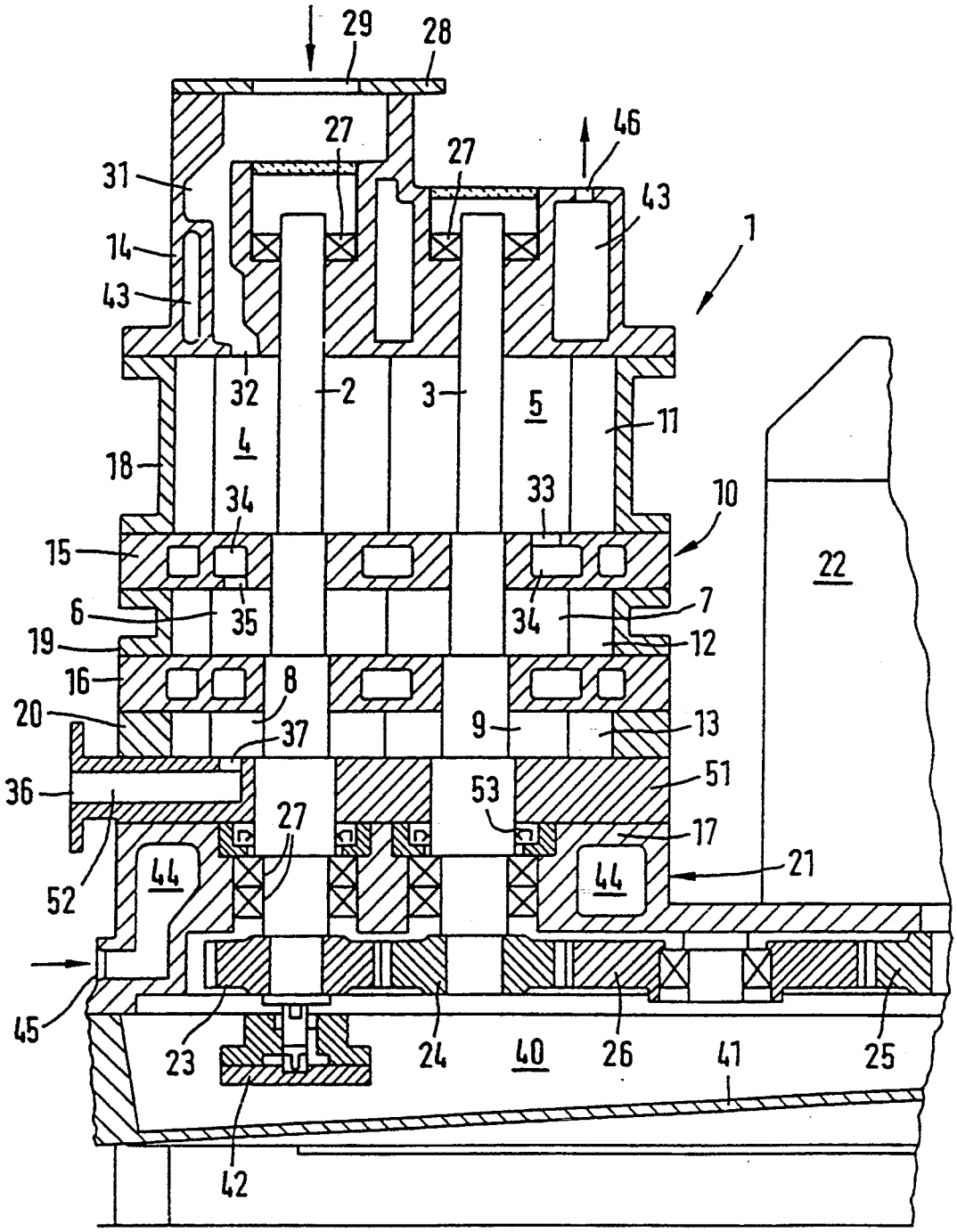
FIG. 1 shows a twin-shaft vacuum pump with an intermediate place according to the invention, and FIG. 2 an enlarged detail of a section of the shaft in the area of the drive chamber and the adjacent pumping chamber.

The pump represented in FIG. 1 is a three-stage vacuum pump 1 with two shafts 2 and 3 as well as three pairs of rotors 4 and 5, 6 and 7, and 8 and 9. The axial length of the rotors decreases from the suction side to the discharge side. The rotary pistons are of the claw type (Northey, cf. for example EU-A-290,662) and rotate in the pumping chambers 11, 12 and 13 which are formed by plates 14 to 17 and the housing rings 18 to 20. Plate 17 is formed by the wall section of the drive housing 21, which is associated with the discharge-end pumping chamber 13.

The shafts 2 and 3 are disposed vertically. This is also true of the motor 22 disposed next to the pump housing. Below the bottom bearing plate 17 the shafts 2 and 3 are equipped with gears 23 and 24 of equal diameter which serve to synchronize the motion of the rotor pairs 4 and 5, 6 and 7, and 8 and 9. The motor 22 also has a gear 25 on its bottom end. The driving connection is produced by an additional gear 26 which is engaged with gears 24 and 25.

In the upper bearing plate 14 and in the wall 17 of the drive housing 21 The shafts 2 and 3 are supported by rolling bearings 27. The top bearing plate 14 is equipped with a horizontally disposed coupling flange 28 which forms the inlet 29 of the pump. The inlet passage 31 leads at its end (opening 32) into the pump chamber 11 of the first stage. The outlet opening at the end of the first stage is marked 33 and leads into the connecting passage 34. The connecting passage 34 in plate 15 communicates with the inlet opening 35 of the second stages. The bearing plate 16 is configured accordingly. Under the bottom (third) pump stage is the outlet 36 which communicates with the outlet opening 37.

Underneath the system consisting of pump housing and motor is the drive housing 21 which comprises the oil-containing chamber 40 and the oil pan 41. An oil pump 42 connected with the shaft 2 reaches into the drive housing 21. Lubricant passages not shown in detail run from the oil pump to those points in the pump (bearings, points of engagement of the gears 23 to 26, retaining rings or the like) which require oil lubrication. The bearings 27 at the upper shaft ends are preferably greased.

The embodiment represented, of the three-stage twin-shaft vacuum pump, is water-cooled. To that end, cooling water passages 43 and 44 are provided in the bearing plates 14 and in the drive housing 21 17. The cooling water inlet and outlet are marked 45 and 46. The cooling water inlet 45 is located at the lowermost point of the passage system 43, 44, so that easy drainage and complete emptying are assured.

The pump represented is equipped in the manner of the invention with an intermediate plate 51 which separates the drive housing 21 from the other components forming the pumping chambers 11 to 13. The intermediate plate 51 is removably fastened to the drive housing and itself forms a wall section defining the pumping chamber 13. It contains the exhaust line 52 running laterally outward from the outlet opening 37. After the easy disassembly of the components (including intermediate plate 51) forming the pumping chambers 11 to 13, which are contaminated if the pump is used with toxic media, all of the parts to be decontaminated are disassembled. Decontamination of the drive housing, which is difficult to assemble, can therefore be avoided in service operations. The bearings 27 and a radial shaft sealing ring 53 associated with each of the shafts, which is usually present, are located, as in the state of the art, in the wall section 17 of the drive housing 21. After the intermediate plate 51 is removed, these components are freely accessible for maintenance operations.

Figure 2:
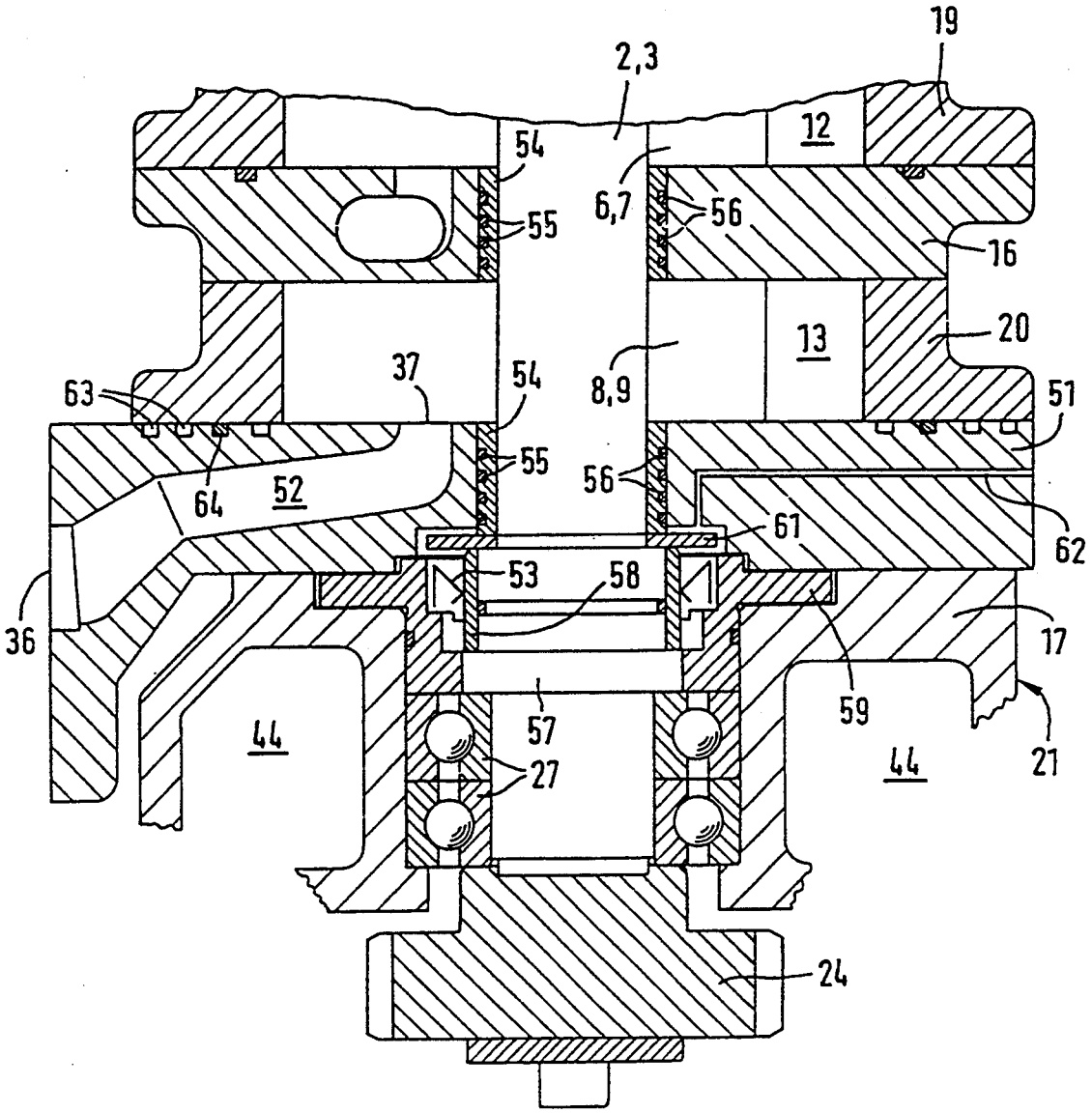

FIG. 2 shows an enlarged fragmentary section through a pump I according to the invention in the area where the shafts 2 and 3 (only one is visible) pass through the bearing plate 16, the discharge end pump chamber 13, the intermediate plate 51, and the wall section 17 of the drive housing 21. To seal off from one another the adjacent chambers (pumping chambers and drive chamber), bushings 54 rotating with the shafts are provided, which have annular grooves 55 on their outer side. In the grooves 55 are the stationary piston rings 56 which together with the grooves 55 form labyrinth seals.

The shafts 2, 3 are supported at a portion of greater diameter 57 on the bearings 27. This portion of greater diameter 57 is followed upwardly by a bushing 58 for the radial shaft sealing ring 53. This ring is held externally in an annular component 59 which is recessed into the wall section 17 of the drive housing 21 and is fastened thereto. Between the bushing 58 and the piston ring bushing 54, i.e., above the radial shaft sealing ring 53, there is also a slinger disk 61 which protects the radial shaft sealing ring 53 against any falling dust particles.

At the level of the slinger disk 61, which is in the boundary area between the intermediate plate 51 and wall section 17, there enters a sealing gas line 62 which passes through the intermediate plate 51, i.e., through an easy-to-cast component. Due to the feeding of sealing gas at this point, gas is constantly flowing through the labyrinth seal above it toward the pumping chamber 13, so that toxic fluids being pumped cannot flow in the opposite direction. In the state of the art it was necessary to bring any necessary inert gas lines through the cooling passages in the drive housing, in a manner which complicated manufacture.

In many applications of pumps of the kind here concerned it is desirable for the walls around the pumping chambers to be as hot as possible during operation. There are limits to achieving this in the state of the art because the drive housing is cooled. However, as a result of the intermediate plate 51 according to the invention it is possible to separate the drive housing thermally from the pumping chambers to a very great extent. This can be accomplished by making the intermediate plate of material that is a poor conductor of heat (e.g., gray cast iron, high-grade steel, or the like) and/or by taking measures ([by providing] gaps or the like) to reduce the contact area between the intermediate plate 51 and the adjoining components (ring 20, wall 17). In the embodiment according to FIG. 2, a plurality of grooves 63 are provided, one of which serves to accommodate a sealing ring 64.

We claim:

1. Dry-running twin-shaft pump of a claw type comprising:

at least one pumping chamber having two ends;

two shafts bearing at least one rotor pair of a claw type situated in the at least one pumping chamber;

a drive housing associated with one of the two ends of the pumping chamber;

a wall portion of said drive housing facing the pumping chamber;

bearings which are situated in the wall portion and support the two shafts which pass through the wall portion;

between the drive housing and the pumping chamber which is adjacent thereto, an intermediate plate removable from the wall portion and containing an axial exhaust opening and a lateral exhaust duct communicating with the exhaust opening and through which intermediate plate the two shafts pass.

2. Pump according to claim 1, in which the shafts are disposed vertically.

3. Pump according to claim 1, which is multi-stage.

4. Pump according to claim 1, in which the shafts in the area of the intermediate plate have bushings.

5. Pump according to claim 1, which includes associated with each of the shafts a radial shaft sealing ring which is situated between the bearings and the intermediate plate.

6. Pump according to claim 5, which includes a slinger disk disposed above each of the radial shaft sealing rings.

7. Pump according to claim 1, in which the intermediate plate contains a sealing gas line leading into a boundary area between the intermediate plate and the drive housing.

8. Pump according to claim 1, in which the intermediate plate comprises material that is a poor conductor of heat.

* * * * *